United States Patent [19]

Blackman

[11] 4,206,810

[45] Jun. 10, 1980

[54] METHOD AND APPARATUS FOR INDICATING THE DOWNHOLE ARRIVAL OF A WELL TOOL

[75] Inventor: Bruce A. Blackman, Duncan, Okla.

[73] Assignee: Halliburton Company, Duncan, Okla.

[21] Appl. No.: 917,222

[22] Filed: Jun. 20, 1978

[51] Int. Cl.[2] ..... E21B 7/12

[52] U.S. Cl. ..... 166/336; 175/40; 340/861

[58] Field of Search ..... 340/18 NC, 18 FM; 175/40, 45, 50, 4.51; 166/336, 368, 365, 66, 65 M, 363, 250, 255, 361, 367, 362, 75, 364, 358, 369; 73/151

[56] References Cited

U.S. PATENT DOCUMENTS

| | | | |
|---|---|---|---|
| 2,255,721 | 9/1941 | Mattingly et al. | 175/45 |
| 2,999,557 | 9/1961 | Smith et al. | 340/15.5 TN |
| 3,103,976 | 9/1963 | De Vries et al. | 166/336 |
| 3,105,551 | 10/1963 | Ehlert | 166/225 X |
| 3,233,674 | 2/1966 | Leutwyler | 166/65 R |
| 3,633,685 | 1/1972 | Piexoto | 175/45 X |
| 4,061,967 | 12/1977 | Hall | 166/65 M |
| 4,121,657 | 10/1978 | McClure | 175/45 |

*Primary Examiner*—James A. Leppink
*Assistant Examiner*—Richard E. Favreau
*Attorney, Agent, or Firm*—John H. Tregoning; William J. Beard

[57] ABSTRACT

Disclosed is a method and apparatus for indicating the downhole arrival of a well tool. The disclosed embodiment includes placing a magnet on the top releasing plug of a subsea releasing plug apparatus for cementing offshore oil wells, and sensing the arrival of the magnet with a magnetic switch in the well bore at the seafloor. An acoustic signal is sent from the seafloor to the ocean surface over a pipe string in the well at one frequency before the closure of the magnetic switch, and at a second frequency after the arrival of the top releasing plug closes the magnetic switch. The apparatus includes means at the surface for displaying the acoustic signal being received over the pipe string.

8 Claims, 5 Drawing Figures

METHOD AND APPARATUS FOR INDICATING THE DOWNHOLE ARRIVAL OF A WELL TOOL

BACKGROUND AND SUMMARY OF THE INVENTION

This invention is related to the sensing of the descent of oil well tools in an oil well bore, and is more particularly directed to the indication of the arrival of an oil well tool such as a cementing plug at a predetermined position in the well bore during operations in the oil well such as a cementing operation.

In an oil well cementing operation, generally two plugs are used to separate the cement from other fluids in the oil well. Generally, a first plug is released and cement pumped above the plug for separating the cement from fluid in the well. After the proper amount of cement has been pumped into the well, a second plug is released for separating the cement from fluid above the cement. Additional fluid is then pumped into the well to displace the cement through the well casing. When the first plug reaches the bottom of the well, it drops out of the center string and the cement following the first plug is displaced out the bottom of the center string and up the annulus surrounding the string until the well annulus is completely filled with the cement. In the desired operation the volume of the cement is closely calculated such that when the well annulus is filled, the second plug has reached the bottom of the string and wiped the interior of the string clean of cement during its descent.

In offshore operations, the cement used in the operation is delivered to the casing string to be cemented into place by a smaller diameter drill string. In this case, a larger second plug is held in place by a specially designed latching mechanism at the lower end of the smaller drill string. A specially designed top releasing plug is released from the surface and is pumped down behind the cement. The cement flows through a center bore in the second plug into the casing and from there into the well in the conventional manner. The top releasing plug seats in the second plug, and the second plug is then released and the two plugs in sealing relationship are then pumped behind the cement in the conventional manner.

In the cementing operation, it is advantageous to know when the top releasing plug has reached the second plug in order to determine, among other things, when the full amount of cement has been pumped out of the center of the casing string and into the annulus surrounding the string.

In the past, the pressure of the fluid pumping the top releasing plug into the borehole has been observed and when the top releasing plug seats in the second plug an increase in pressure is observed until the second plug is released. However, many times the second plug is released without the mentioned pressure increase.

In the Smith et al U.S. Pat. No. 2,999,557 issued Sept. 12, 1961, a transmitter is located in a housing above the borehole to send acoustic pulses down the borehole. The pulses are reflected by a plug which is made of a substance having a high acoustic impedance. The reflected pulses are then detected by a microphone and processed and displayed on a recorder to provide an indication of the location of the plug as the plug descends into the borehole.

In the present invention, an acoustic transmitter is positioned at a desired location in the drill string in the borehole. The transmitter gives an acoustic signal when it senses the passing of the well tool to give a surface indication that the well tool has reached the predetermined location of the transmitter. Further, the use of a surface indicating means is disclosed which includes a visual indicating means and an acoustic indicating means responsive to the signals received from the down hole transmitter.

In the preferred embodiment disclosed, a magnet is attached to the plug to be sensed. The mentioned magnet causes a magnetic switch in the acoustic transmitter to close. A circuit is disclosed wherein the magnetic switch controls the acoustic signal. The disclosed embodiment has an oscillator which drives the acoustic transmitter at one frequency and whose frequency of oscillation is changed upon the momentary closing of the magnetic switch.

DESCRIPTION OF THE PREFERRED EMBODIMENT

Figure 1:
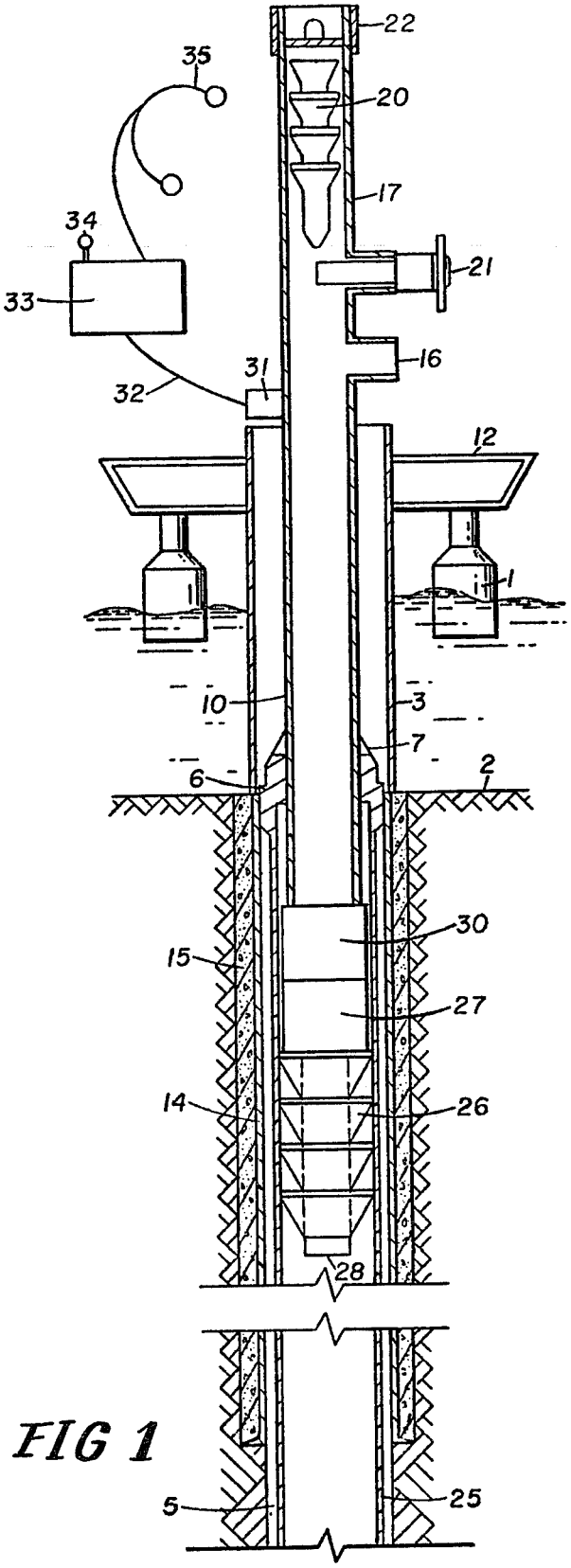
FIG. 1 is a cross-sectional view of a typical offshore oil well installation with the apparatus of the invention installed.

The apparatus of the invention is shown in FIG. 1 in connection with a subsurface release cementing plug system for use in cementing an offshore oil well. The offshore oil well includes a floating work station 1 positioned over a well bore 5 in the ocean floor 2. A marine conductor pipe 3 extends from the floating work station 1 to the sea floor 2 and is centered over the submerged well bore 5. A steel casing 14 is cemented into place by cement 15 and extends from the sea floor 2 into the well bore 5 as is known in the art. The illustrated apparatus is used to cement a subsequent steel casing 25 into a newly drilled portion of the well bore as is known in the art. The steel casing 25 is attached to the subsea head 6 and extends downwardly into the newly drilled portion of the oil well bore 5.

The apparatus of the present invention is illustrated in FIG. 1 as might be installed in a subsurface release cementing plug apparatus. Only those portions of the cementing apparatus necessary to make the operation of the invention clear are illustrated. The full apparatus is illustrated and discussed on pages 3136 and 3137 of the Sales and Service Catalog No. 39 of Halliburton Services, Duncan, Oklahoma, the assignee of the present invention.

A plug container 17 at the top of the drill pipe 10 contains a top releasing plug 20, and is capped by a cap means 22. The top releasing plug 20 is held in place by a plug release plunger assembly 21. In the drill pipe 10 below the plug release plunger assembly 21 is a cement inlet 16 which is used to pump cement into the drill pipe 10 and the connected casing 25. At the bottom of the drill pipe 10 below the subsea head 6 and positioned in the top of the steel casing 25 is a top plug releasing mechanism 27 to which releasably holds a top cementing plug 26 as shown.

The top cementing plug 26 contains a central bore 28 therethrough for passing cement from the drill pipe into the steel casing 25 as is known in the art. When the desired amount of cement has been pumped into the drill pipe through cement inlet 16 to cement casing 25 into place, the plug release plunger assembly 21 is activated to release the top releasing plug 20.

A displacing liquid is pumped into the drill pipe 10 above the top releasing plug 20 to pump plug 20 downwardly through the drill pipe 10 and into a seat in the top plug 26. Pressure is then applied to the top of top releasing plug 20 which causes the latching mechanism 27 to release the top plug 26. The top plug 26 sealed by top releasing plug 20 is then pumped down the bore of the casing 25 displacing the cement below plugs 20 and 26 out the bottom of the casing 25 and up the annulus surrounding the casing 25 as is known in the art.

The apparatus of the present invention includes an acoustic signal transmitting apparatus 30 at the bottom end of the drill pipe 10 and positioned just above the top plug releasing mechanism 27. The acoustic signal transmitting apparatus 30 includes a central bore through which the top releasing plug 20 may pass on its way to seal the central bore 28 of the top plug 26.

At some convenient location near the top of the drill pipe 10 is an acoustic transducer or microphone apparatus 31 attached to the drill pipe. An electrical conductor 32 transmits the detected acoustic signals from transmitter apparatus 30 to an electrical acoustic signal indicator means 33. The indicator means 33 includes an indicating light 34 and a head set 35.

The acoustic signal transmitting apparatus 30 includes a sensing means which senses the passing of top releasing plug 20, and responsive thereto transmits an acoustic signal up the drill pipe 10 to the acoustic transducer means 31. The acoustic signal received by transducer means 31 is detected by detecting means 33 and displayed visually by indicating light 34 and acoustically by head set 35.

Figure 2:
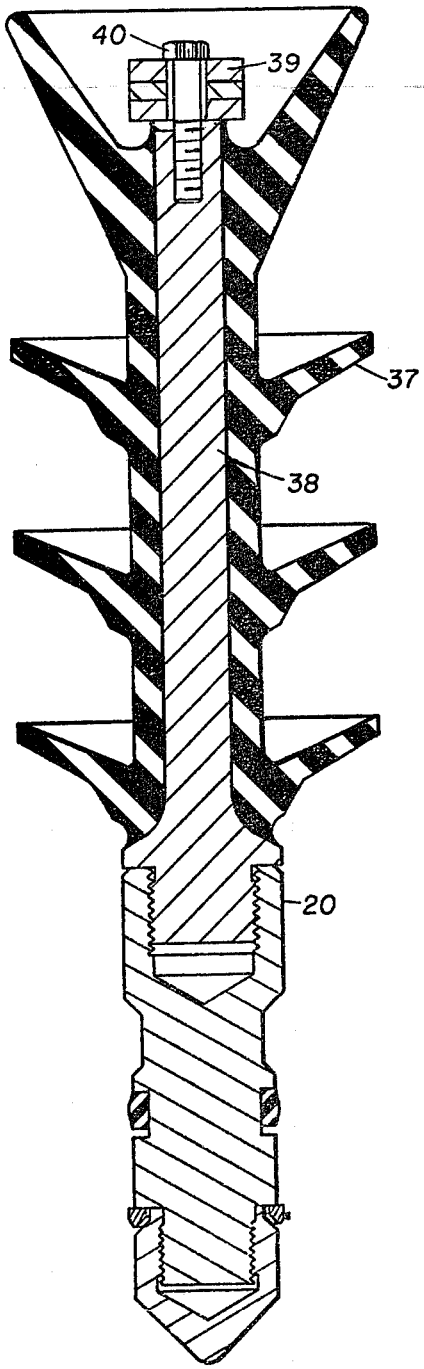
FIG. 2 is a cross-sectional view of a top releasing plug showing the magnets to be sensed in position.

The top releasing plug 20 is illustrated in cross-section in FIG. 2 and includes a plurality of rubber fins 37 sized to be in contact with the inner bore of the drill pipe 10. These fins wipe the drill pipe walls clean and provide a seal between the displacing liquid above the releasing plug and the cement below the top releasing plug during its descent through the drill pipe 10. The top releasing plug 20 normally includes a metal body 38 which extends through the center of the rubber fin assembly 37.

One preferred embodiment of the top releasing plug 30 includes a stack of ceramic magnets 39 held into place at the top of the metal body 38 by an appropriate means such as bolt 40. This stack of magnets 39 may then be sensed by an appropriate sensing means in the acoustic transmitting device 30 to indicate when the top releasing plug 20 has passed through the acoustic transmitting means 30 into top plug 26. Other sensing means will be readily apparent to those skilled in the art for sensing the passage of the top releasing plug through the acoustic transmitting apparatus 30.

The acoustic transmitting apparatus 30 and the top plug releasing mechanism 27 may further be sized such that the sensing means in the apparatus 30 does not sense the passing of the top releasing plug 20 until the top plug 26 has been released by latching mechanism 27. This arrangement would ensure that an acoustic signal or acoustic signal change is not transmitted by apparatus 30 until after the top plug has in fact left the latching mechanism 27.

Figure 3:
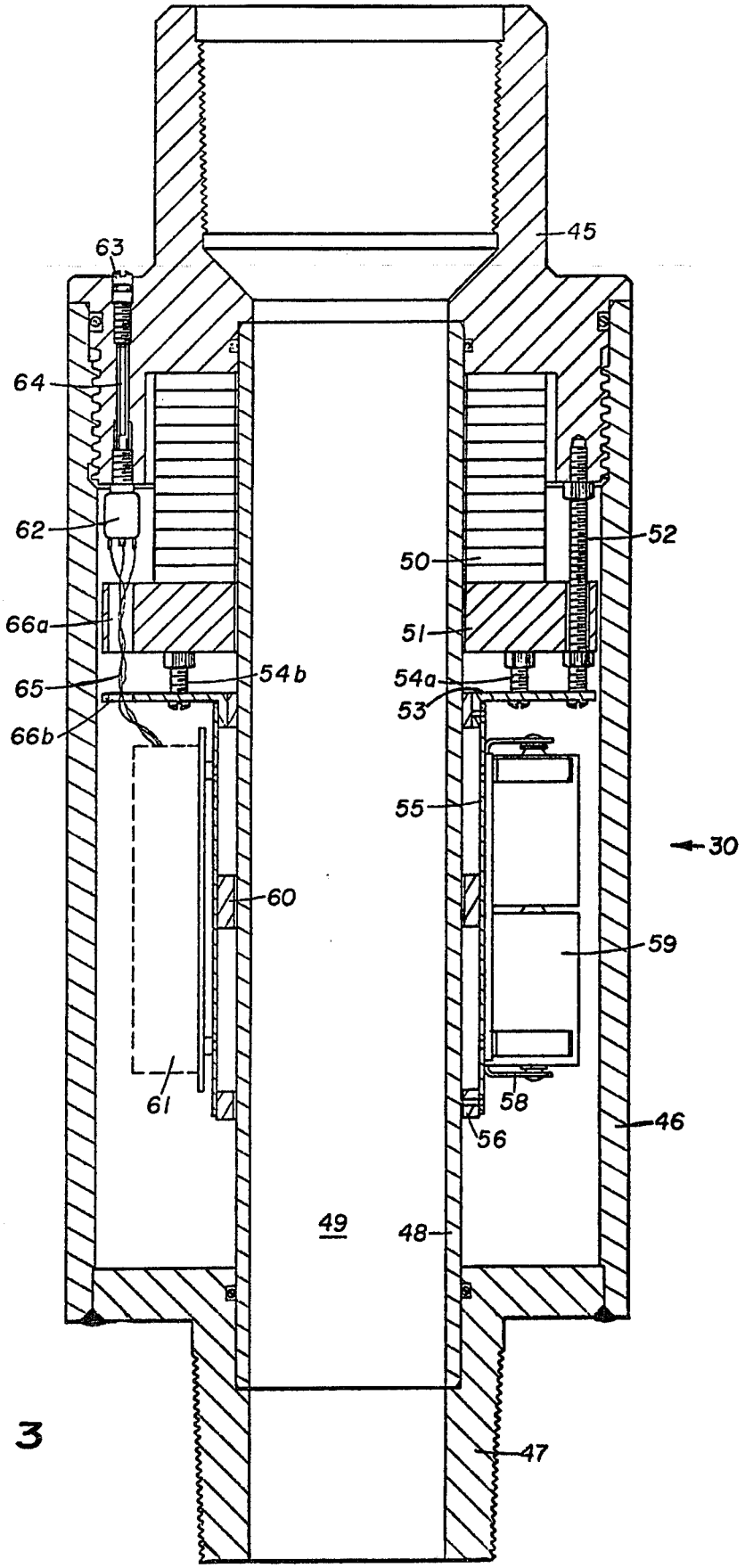
FIG. 3 is a cross-sectional view of the acoustic transmitter apparatus which is located at the desired position in the borehole.

The acoustic signal transmitting apparatus 30 is shown in cross-section in FIG. 3. The apparatus 30 has a casing including a top end casing 45, an outer casing 46 and a bottom end casing 47. The top end casing 45 and the bottom end casing 47 are threaded and shaped such that the apparatus 30 may be installed into a drill pipe string such as shown in FIG. 1.

An inner liner 48 in the form of a hollow tube is sealed within the casing of apparatus 30 as shown in FIG. 3 providing an open bore 49 longitudinally through the apparatus 30. The open bore 49 has sufficient dimensions such that the top releasing plug 20 may pass therethrough. The material of inner liner 48 of the preferred embodiment is made of a non-magnetic material, such as stainless steel.

Installed within the annular chamber between the liner liner 48 and the outer casing 46 is an acoustic transducer 50 such as a plurality of wafers made up of lead zirconate crystals for imparting an acoustical signal to the casing of the apparatus 30 when subjected to appropriate electrical signals. The acoustic transducer 50 is held in close contact with the top end casing 45 by a crystal support 51 bolted into place by mounting bolts 52.

An upper support 53 is secured to the crystal support by bolts 54*a* and 54*b*. The upper support 53 secures a battery holder 55 in place which is additionally secured by a lower support 56 attached to the inner liner 48. The battery holder 55 is a tubular sleeve to which is attached an electronic package 61 and a battery clip 58 for holding electrical batteries 59. The electronics package 61 will be further discussed in connection with FIGS. 4 and 5.

Also connected to the battery holder 55 is a switch mounting ring 60 which in a preferred embodiment holds magnetic switches for sensing the passing the top releasing plug through the bore 49 of inner liner 48.

An on-off switch 62 is provided in the top end casing 45 as shown and includes an on-off switch control screw 63 connected to the on-off switch 62 by a switch extension shaft 64. The on-off switch control screw 63 is rotatably sealed into the top end casing for providing a fluid-tight seal while allowing the on-off switch 62 to be moved between the "off" condition to the "on" condition without disassembling the apparatus 30. Appropriate conductors 65 lead from the on-off switch to the electronics package 61 through bores 66*a* and 66*b* in the crystal support 51 and the upper support 53 respectively.

Figure 4:
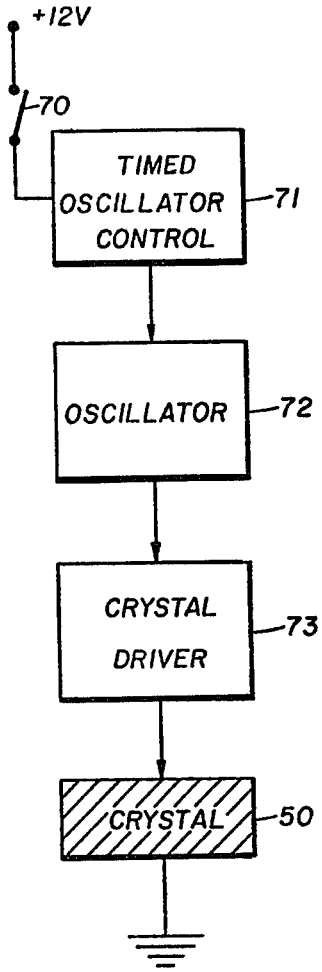
FIG. 4 is a block diagram of the preferred electronics in the acoustic transmitter apparatus.

Shown in FIG. 4 is a block diagram of the electronics contained within electronics package 61 and comprises a switch means 70 which is able to detect the passing of the top releasing plug 20. The switch means 70 controls a timed oscillator control 71 which controls the operating frequency of an oscillator 72. The oscillator 72 in turn controls a crystal driver circuit 73 which applies an electrical signal to acoustic transmitter means 50 such as the lead zirconate crystal wafers of the preferred embodiment.

In the preferred embodiment the oscillator 72 controls the crystal driver circuit 73 at one frequency and its rate of oscillation is changed to a second frequency upon the momentary closing of switch 70 responsive to the sensing of the passing of top releasing plug 20. This changing of frequency is accomplished by activating the timed oscillator control 71. This oscillator control 71 is timed for a set length of time such as 5 minutes, after which the oscillator 72 is returned to its first frequency. This arrangement is advantageous in that if the switching means 70 is accidentally momentarily closed while the transmitting apparatus 30 is being lowered into the position shown in FIG. 1, the frequency of the oscillator 72 will automatically be returned to its first frequency after a predetermined time.

Having the acoustic signals transmitted at a first frequency and then altered to a second frequency with the passing of the top releasing plug is also preferred. In this manner, it is possible to monitor the operation of the transmitting apparatus 30 during the lowering of the drill string 10 into position to ensure that the apparatus 30 is working properly. An alternate method would be to either initiate or terminate the acoustic signal upon passing of the top releasing plug 20. However, such an operation would leave the possibility that such initiation or termination of the acoustic signal resulted because of a failure of the electrical circuit rather than the passing of the top releasing plug. For these reasons, the changing of the acoustic signal from one frequency to another with the passing of the top releasing plug 20 as herein disclosed is the more preferred method.

Figure 5:
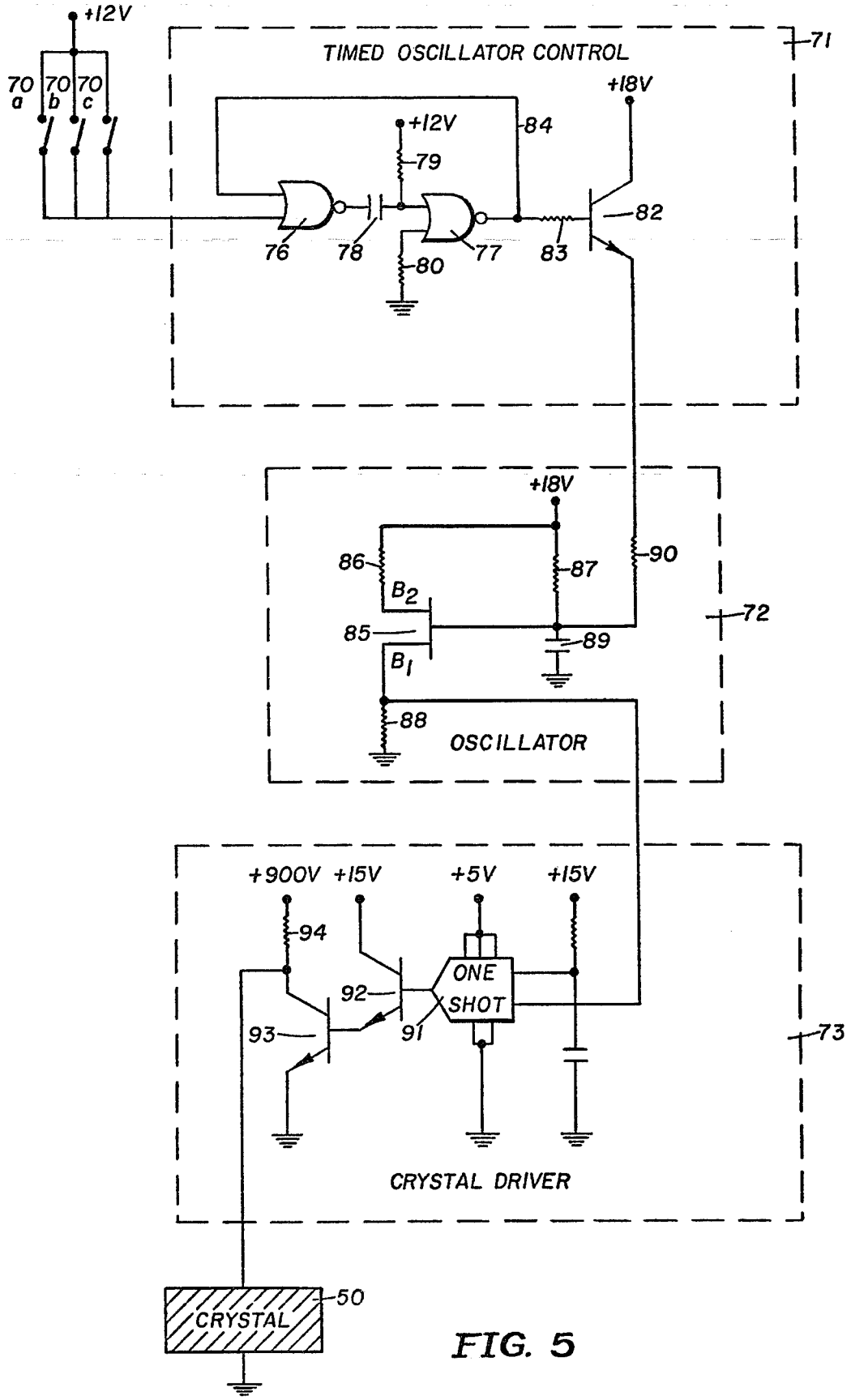
FIG. 5 is a schematic diagram of the electronics of FIG. 4.

In FIG. 5 is shown a schematic diagram of the electronics package 61 of the preferred embodiment. A plurality of individual switches 70*a*, 70*b*, and 70*c* are connected in parallel, and are preferably magnetic switches capable of sensing the magnets 39 bolted to the top releasing plug 20. The momentary closing of any one of the individual magnetic switches is sufficient to turn on the timed oscillator control 71. The timed oscillator control 71 comprises a NOR gate 76 and a NOR gate 77 connected in series as shown. Between the two NOR gates is capacitor 78 and resistor 79 connected as shown. The RC time constant of capacitor 78 and resistor 79 determines the time during which the oscillator control is turned "on." A resistor 80 is connected to one input of NOR gate 77 and is grounded to give a continual low signal to one input of gate 77. The output of NOR gate 77 is connected to the base of a transistor switch 82 through resistor 83.

One input of NOR gate 76 is connected to the switch means 70. The second input of NOR gate 76 is connected by a conductor 84 to the output of NOR gate 77 to provide a loop between the input of NOR gate 76 and the output of NOR gate 77.

The oscillator circuit 72 comprises a uni-junction transistor 84 and the resistors 86, 87, and 88 connected as shown and known in the art. The oscillator circuit 72 also includes a capacitor 89 whose rate of charging and discharging controls the output frequency of the oscillator circuit 72.

A parallel resistor 90 is controlled by the timed oscillator control 71 and is added into the oscillator circuit 72 when the transistor switch 82 is turned to the "on" condition. It will be understood that the frequency output of the oscillator 72 is changed when transistor 82 is turned "on."

The crystal driver circuit 73 comprises a one-shot device 91 which is controlled by the output of the oscillator circuit 72. The one-shot device 91 is connected to transistor 92 and 93 which are in the Darlington configuration to provide a switch which shunts the high voltage being supplied to the crystal means 50 through resistor 94 to ground when the one-shot 91 is fired.

When the high voltage is supplied to the crystal means 50, the individual crystal wafers, as is known in the art, assume a certain size. When the high voltage is suddenly shunted to ground by the operation of the one-shot 91, this high voltage is removed from the crystal wafers and they assume a second size which causes a knock or an acoustic signal to be transmitted to the casing of the apparatus 30, and to the connected drill pipe 10. The acoustic signals are sensed by the acoustic transducer 31 and are indicated visually by the light means 34 and acoustically by the head set 35 of the indicating means 33.

When one of the magnetic switches 70*a*, 70*b*, or 70*c* is momentarily closed by the passing of the magnets 39, a high signal is momentarily imparted to one of the inputs of NOR gate 76. When the high signal is received by the NOR gate 76, the output of gate 76 goes low such that both of the inputs to NOR gate 77 are in the low condition.

When both inputs to gate 77 are in the low condition, the output of gate 77 goes to the high condition to turn on the transistor switch 82. The loop conductor 84 transmits the high output of gate 77 to one of the inputs to NOR gate 76 such that the output of gate 76 remains in the low condition after the switch means 70 has returned to the open position.

The voltage to one of the inputs to NOR gate 77 is increased as the capacitor 78 is charged until that input is raised to a sufficiently high condition to switch the output of NOR gate 77 to the low condition. In the preferred embodiment the capacitor 78 and the resistor 79 are so sized that the time needed to switch the output of NOR gate 77 from the high condition back to the low condition is approximately five minutes.

It can be seen that when transistor switch 82 is turned off, the oscillator circuit 72 will oscillate at one frequency dependent upon the size of capacitor 89 and the resistors in the oscillator circuit 72.

When the transistor switch 82 is turned on, resistor 90 is included in the oscillator circuit 72 such that the charging rate of capacitor 89 is changed, and the output frequency of the oscillator circuit 72 is changed to a new second frequency. It is this change in frequency of oscillator 72 that is indicative of the passing of the top releasing plug 20. The preferred rate of the first frequency is approximately one hertz, and the preferred rate of the second frequency is approximately three hertz.

A preferred acoustic transducer 31 is an accelerometer commercially available from a number of sources such as Columbia Research Lab, Inc., of Woodlyn, Penn. 19094. Such an accelerometer includes a piezoelectric wafer loaded by weight. Acoustic energy traveling up the drill string 10 from the acoustic transmitter apparatus 30 stresses the piezoelectric wafer to transmit an electrical signal over conductor 32 to the indicating means 33. The indicating means 33 includes a band-pass filter passing a band of approximately 4,000 hertz to assist in filtering out mechanical noises such as machinery, etc. imparted to the drill string 10. The indicating means 33 additionally includes known amplifier circuits to light the bulb 34 and to produce a sound over the head set 35 responsive to the filtered electrical signal from acoustic transducer 31.

Illustrated heretofore is an embodiment of the invention whereby the arrival at a predetermined location in a well bore of a top releasing plug may be sensed and acoustically transmitted to a surface monitoring apparatus. The invention disclosed could well be used in connection with other well equipment such as pressure gauges, logging tools, and other specialized oil well equipment. As illustrated, the transmitting apparatus is located on the seafloor, and an acoustic signal indicating the arrival of a well tool at the seafloor is transmitted to the surface over the drill string. The acoustic signal from the transmitting apparatus can easily be transmitted and received over the drill pipe extending from the surface of the sea to the seafloor in the offshore drilling rigs presently in use. As will be understood by those skilled in the art, the present invention may be used at deeper ocean depths or deeper in the bore hole by the use of appropriate acoustic signal repeaters. By use of various detection methods and appropriately timed intervals, the arrival of several different pieces of equipment at the same time or different times could be sensed and acoustically transmitted to the surface.

It is therefore to be understood that the foregoing disclosure and the embodiment described therein is illustrative only, and the scope of the invention intended to be protected is defined by the appended claims and the equivalents thereof.

What is claimed is:

1. An oil well apparatus for indicating the passing of an oil well tool at a predetermined point in the well bore comprising:

an acoustic transmitting apparatus locatable at a predetermined point in the well bore for sensing the passing of the oil well tool and for transmitting an acoustic signal responsive to said sensing of the oil well tool;

acoustic conducting means extending from said acoustic transmitting apparatus to the surface for conducting said acoustic signal from said acoustic transmitting apparatus to the surface;

indicating means acoustically connected to said acoustic conducting means for sensing and indicating said acoustic signal received from said acoustic conducting means;

oscillator means for producing acoustic signals at a first normal operating frequency; and oscillator control means responsive to the sensing of said passing oil well tool for controlling said oscillator means subsequent to the passing of said oil well tool at a second frequency for producing acoustic signals at said second frequency subsequent to the passing of said oil well tool.

2. The apparatus of claim 1 wherein said indicating means comprises a visual indicating means for visually displaying indications of said acoustic signal, and means for acoustically producing indications of said acoustic signal.

3. An apparatus for sensing the passing of an oil well tool comprising:

housing means adapted for installing the apparatus into an oil well pipe string;

a tubular sleeve in said housing means for providing a bore through said housing means and spaced from said housing means for providing an annular cavity between said tubular sleeve and said housing means;

normally open switch means operable for momentarily moving to the closed position responsive to the passing of an oil well tool; and acoustic signal means for imparting acoustic signals to said housing means responsive to the momentary closing of said switch means.

4. The apparatus of claim 3 further comprising oscillator means in said acoustic signal means for producing said acoustic signal at a first normal operating frequency, and control means responsive to said switch means for controlling said oscillator means at a second operating frequency responsive to the closing of said switch means.

5. The apparatus of claim 3 wherein said switch means comprises a magnetic switch closable upon the passing of a magnet through the bore of said tubular sleeve.

6. The method of sensing the passing of an oil well tool at a predetermined depth in the oil well comprising the steps of:

installing in said oil well tool detectable means arranged to be sensed down hole;

installing at a predetermined point in said well bore an acoustic signal transmitting means;

lowering said oil well tool into the oil well bore;

sensing with said acoustic transmitting means said detectable means installed on said oil well tool;

generating an acoustic signal responsive to the sensing of said detectable means;

sensing at the surface said generated acoustic signal; and indicating at the surface said sensed acoustic signal.

7. The method of claim 6 wherein the step of generating an acoustic signal comprises changing the frequency of the acoustic signal transmitted by said acoustic transmitting means.

8. A method of sensing the arrival at the seafloor of a top releasing plug in a cementing operation of an offshore oil well comprising:

installing a magnet in the top releasing plug;

pumping the top releasing plug into the offshore oil well;

closing a magnetic switch at the seafloor responsive to the passing of said magnet installed in said top releasing plug;

generating an acoustic signal responsive to the closing of said magnetic switch;

transmitting said acoustic signal over a pipe string extending from the ocean surface to the seafloor of the offshore oil well;

receiving the acoustic signal at the surface transmitted over the pipe string; and indicating at the surface said received acoustic signal.

* * * * *